United States Patent [19]

Dawson

[11] 4,373,558

[45] Feb. 15, 1983

[54] BOOKBINDING WIRE STOCK PRODUCTION METHOD AND APPARATUS

[75] Inventor: Kenneth H. Dawson, Newark, Calif.

[73] Assignee: Spiral Binding Company, Inc., Clifton, N.J.

[21] Appl. No.: 190,447

[22] Filed: Sep. 24, 1980

[51] Int. Cl.[3] ..... B21F 1/04

[52] U.S. Cl. ..... 140/71 R; 140/105

[58] Field of Search ..... 11/1 A; 140/71 R, 105, 140/82, 90; 72/187, 191, 190

[56] References Cited

U.S. PATENT DOCUMENTS

| | | | |
|---|---|---|---|
| 3,556,166 | 1/1971 | Whitney | 140/71 R |
| 3,691,808 | 9/1972 | Calvert et al. | 140/105 X |
| 4,047,544 | 9/1977 | Seaborn et al. | 140/105 |

FOREIGN PATENT DOCUMENTS

| | | | |
|---|---|---|---|
| 2908223 | 9/1980 | Fed. Rep. of Germany | 140/71 R |

*Primary Examiner*—Kenneth J. Ramsey
*Attorney, Agent, or Firm*—Charles E. Baxley

[57] ABSTRACT

An illustrative embodiment of the invention produces comb-like bookbinding wire stock in a manner that significantly reduces wire breakage during manufacture as well as unequally stressing or stretching or marring the surface finish of the wire from which the stock is formed. An indexing unit drives a pair of forming arm members that pivot under the control of a cam surface. These members align and wind a wire strand onto pins that protrude radially from a pair of parallel, axially spaced rings. Operation of a reciprocating side pusher and center pusher shaft press the wire strand onto the adjacent pins and a wire flattening roller presses one side of the partially formed stock against the adjacent pin surfaces to produce the "back" for the comb-like stock. A rotating pinch roll "sets" the fingertip portions of the tines on the stock. Because the plane surfaces of the circular rings are parallel, substantially less time is required to set up the machinery that characterizes the invention and undertake a production run than that which characterized prior art devices.

5 Claims, 2 Drawing Figures

BOOKBINDING WIRE STOCK PRODUCTION METHOD AND APPARATUS

This invention relates to method and apparatus for manufacturing the specially formed wire stock from which notebook bindings are produced and more particularly, to a drive and indexing unit for manufacturing a serrated, comb-like wire that can be formed subsequently into flexible notebook binding, and the like.

The serrated, comb-like or zig-zag wire stock that is used to bind notebook pages is difficult to manufacture. Typically, this wire stock has a connecting wire, or back from which wire fingers extend in a direction that is perpendicular to the back to produce a comb-like appearance.

In the past, devices wind the wire that is to be formed onto circular rings. This winding technique approximates the actual shape of the wire that is to be formed. The centers of rotation for the forming arms in these devices are offset from the actual centers of wire rotation in an attempt to match an ideal wire path. These approximations cause the wire to slip around the forming arm, frequently damaging the coating on the wire, ruining the appearance of the product, and establishing corrosion loci.

This technique produces unequal lengths and tensions in adjacent sides of the protruding wire fingers which, in turn, results in a product that does not have a uniform appearance. To overcome these problems it has been customary to stretch the wire by winding it across teeth (with rounded corners) that protrude from the peripheries of angularly disposed rings. By adjusting the angular relationship between the planes of the rings, a uniform product appearance is achieved, but only at the increased price of more wire coating damage and increased wire breakage. Further, devices also are needed to keep a tension of 15 to 40 pounds on the wire because of the nature of the winding method. In these circumstances, the wire must be transferred from the forming arm to the teeth on the circular rings under a tension that introduces another source of wire coating damage. In addition to these problems, the angularly disposed ring apparatus is expensive, difficult to design and requires a great deal of adjustment before production can be undertaken. In this respect, the rings are particulary expensive because they must be very rigid and nevertheless sustain heavy loads on the order of 60 to 100 pounds per wire strand during stretching.

Accordingly, it is clear that there is a need for a relatively inexpensive machine that will produce binding wire stock without introducing unequal finger lengths or tensions, reduce fingertip breakage and prevent surface finish marring.

The following United States Patents are illustrative of a number of these prior art winding machines:

U.S. Pat. No. 2,911,014 granted to A. L. Van Nest on Nov. 3, 1959 for "Wire-Crimping Apparatus" shows a device for crimping the wire around a row of prongs, thereby introducing the stresses in the wire that cause the problems under consideration.

U.S. Pat. No. 3,334,918 granted to D. P. Pigna, et al. on Aug. 8, 1967 for "Method and Apparatus for Binding Loose Sheets" shows a technique for kinking the binding wire, thereby introducing wire stresses and surface coating damage.

U.S. Pat. No. 3,623,514 granted Nov. 30, 1971 to Ernst Pfaffle for "Machine for the Manufacture of Wire Binders" shows dies for bending the wire to produce binding wire stock.

U.S. Pat. No. 3,639,966 granted Feb. 8, 1972 to H. D. Scharf for "Variable Crimping Eccentric Press" discloses an apparatus for operating crimping die. Crimping, however, produces the precise defects that have characterized the prior art.

U.S. Pat. No. 3,691,808 granted Sept. 19, 1972 to R. K. Calvert, et al. for "Wire Forming Machine" discloses the angulary disposed ring apparatus for producing bookbinding wire that is considered above.

U.S. Pat. No. 3,805,579 granted Apr. 23, 1974 to R. K. Calvert, et al. for "Wire Forming Method" is a division of the application that matured into the Calvert et al. U.S. Pat. No. 3,691,808 considered above.

U.S. Pat. No. 4,020,516 granted May 3, 1977 to A. Gomez for "Apparatus for Binding Loose Sheets" describes a device that deforms wire into a comb-like bookbinding wire configuration.

U.S. Pat. No. 4,047,544 granted to P. E. Seaborn, et al. for "Wire Forming Apparatus" describes a wire stretching assembly and die arrangement that also relies on angularly disposed rings which lead to the problems considered above.

To overcome these problems of the prior art and, in accordance with the invention, a cam controlled forming arm draws wire from a supply. A pusher on the forming arm presses the wire onto a pin that protrudes from the rim of an indexing ring. As the pin on the ring is indexed away from the center of forming arm rotation the contour of the cam that guides the forming arm through a wire path that completes the winding cycle with minimum tension within the wire that is being formed.

This motion during the balance of the winding cycle causes the forming arm to move toward the center of rotation and enables the wire to transfer to a different pin which protrudes from the rim of another ring, also under an essentially load-free condition. A side pusher transfers the wire and holds the wire on this pin until the ring indexes and carries the span of wire that stretches between the two pins on the opposing rings under a wire hold guide. A rotating pinch roll presses against and sets the wire fingertip that is wound around one side of the pin by slightly overbending the exposed tip. A plane roller moreover, flattens the connecting wire or "back". This action also loosens the wire on the circular rings for easily removal by a stripping device.

For a more detailed understanding of the invention, attention is invited to the figures of the drawing and the accompanying description. The scope of the invention described is, nevertheless limited only through the claims appended hereto.

Figure 1:
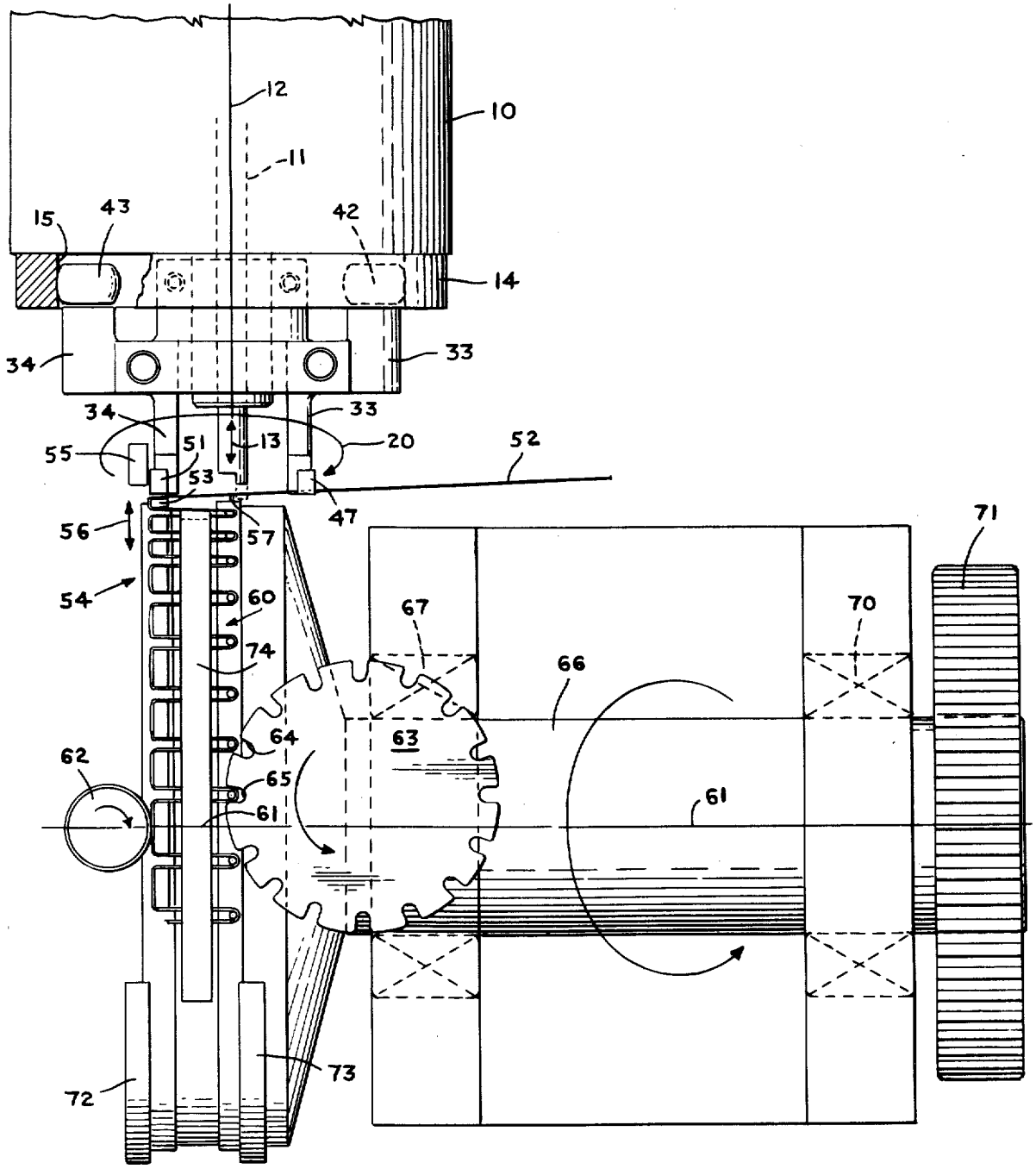
FIG. 1 is a side elevation of a bookbinding wire winding device that embodies features of the invention.

For a more complete appreciation of the invention, attention is invited to FIG. 1 which shows a Ferguson drive or other suitable indexing unit 10. The indexing unit 10 rotates or indexes a cylindrical shaft 11 in a stepwise manner about a center of rotation 12. The shaft 11 moreover, is mounted within the indexing unit 10 for reciprocal motion in directions that are parallel with the center of rotation 12, as indicated by means of arrow 13.

Figure 2:
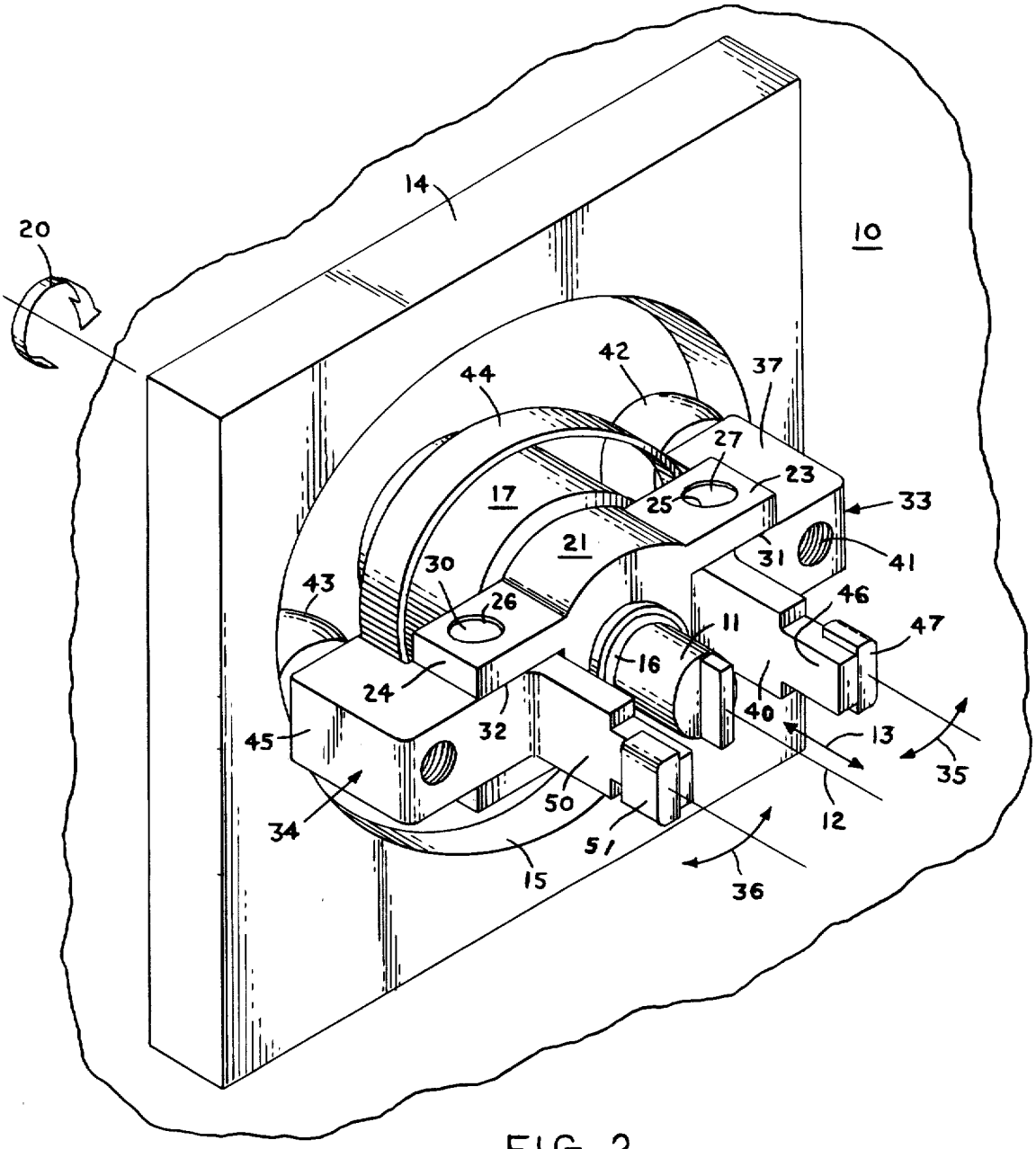
FIG. 2 is a perspective view to show in detail the cam controlled winding assembly that is illustrated in FIG. 1.

As best shown in FIG. 2, a cam plate 14 is mounted on the indexing unit 10. As illustrated, the cam plate 14 has a generally centrally disposed aperture that produces a cam surface 15 through which the center of rotation 12 and the center pusher shaft 11 protrude. The center pusher shaft 11 is received for reciprocal motion in the directions of the arrow 13 within a centrally disposed aperture 16 that is formed within the center of a stepped cylindrical hub 17.

Although the center pusher shaft 11 is capable of sliding within the hub aperture 16 in the direction of the arrows 13, the hub 17 nevertheless is allowed to rotate around the shaft 11 in the direction of arrow 20. A forming arm yoke 21 that is integral with the hub 17 also is concentric with the center of rotation 12. The smaller diameter stepped portion of a one-piece hub 17 protrudes from the forming arm yoke 21 being integral therewith. The forming arm yoke, moreover, has a pair of diametrically disposed U-shaped bosses 23, 24 in which the arms of the bosses extend in opposite directions away from the center of rotation 12. The bosses 23, 24 each have respective holes 25, 26, that receive forming arm pivot pins 27 and 30. These pins 27 and 30 are oriented in a direction that is generally perpendicular to the center of rotation 12 and spaced outwardly from the center of rotation.

Within bights 31, 32 of the U-shaped bosses 23 and 24 respectively, individual Z-shaped forming arm members 33, 34 are mounted by means of the pins 27, 30 for pivotal movement in the directions of the individual arrows 35 and 36. A portion 37 of the forming arm member 33 also is provided with a bore 41 that is spaced outwardly from but parallel with the center of rotation 12. The bore 41 accomodates an axle (not shown in FIG. 2) for a crowned spherical cam follower 42. The working surface of the cam follower 42 bears against the cam surface 15 in the cam plate 14.

The forming arm member 34 that is received within the bight 32 of the U-shaped boss 24 for pivotal motion in the direction of the arrow 36 has a configuration that is similar to the forming arm member 33 described above. Thus, the member 34 mounts a crowned spherical cam follower 43 for rolling engagement with the cam surface 15 to provide the desired motion in the direction of the arrow 36 for the member 34. An arcuate spring 44 presses against the inner surface of the portion 37 of the forming arm 33 and also bears against a corresponding portion 45 of the forming arm member 34. The force applied by the spring 44 presses the spherical cam followers 42 and 43 against the portions of the cam surface 15 with which they are in contact.

Considering once more the forming arm member 33, a portion 40 which is parallel with the portion 37 protrudes from the bight 31 in the U-shaped boss 23 toward the observer as viewed in FIG. 2. This portion 40 has an end 46 of a reduced width that receives and supports a replaceable wear pad 47. In a similar manner the forming arm member 34 also is provided with a portion 50 that is similar to the portion 40 on the member 33. The portion 50 also accommodates on its exposed, protruding end a replaceable wear pad 51.

Turning once more to FIG. 1, the replaceable wear pads 47 and 51 on the forming arm members 33, 34 receive a strand of steel wire 52 from a supply (not shown in FIG. 1). The pad 51, as illustrated in FIG. 1, is in alignment with a pin 53 that protrudes in a radial direction from the rim or perhipery of a circular ring 54. The pin 53 is one of an array of generally rectangular radially protruding pins three of the four sides of which pins respectively shape the configuration of the back of the comb-like stock and a portion of each of two adjacent protruding fingers that comprise the basic stock from which bookbinding wire is formed.

A side pusher 55, which reciprocates in directions that are parallel with the arrow 13, as illustrated by arrow 56, selectively transfers the wire strand 52 from the wear pad 51 to the back and side surfaces of the adjacent pin 53 on the circular ring 54.

In a similar manner, the reciprocal motion of the center pusher shaft 11 in the directions of the arrow 13 presses the strand 52 from the surface of the pad 47 to the surface of a radially protruding pin 57. As shown, the radially protruding pin 57 is one pin in an array of short peg-like pins that protrude in radial directions from the periphery, or rim, of a circular ring 60. The shape of the pin 57, as well as the other pins in the array conforms over its surface through an arc of about 180° to the configuration of a fingertip end of one of the tines in the comb-like stock from which bookbinding wire is formed.

The rings 54 and 60 share a common center of rotation 61 that is concentric with the centers of the respective rings 54 and 60. The flat circular surfaces of the rings 54 and 60 moreover are spaced from each other relative to the center of rotation 61 through a distance that is related to the length of the tines that form the "fingers" of the wire bookbinding stock.

A cylindrical wire flattening roll 62 presses the "back" or connecting wire portion of the stock against the surfaces of the individual pins on the ring 54 that are parallel with the flat ring surface in order to suitably flatten this back portion and to loosen the stock on the ring for easy removal.

Further in this respect a rotating pinch roll 63 has an array of uniformly spaced peripheral notches 64 and 65, each of which sequentially presses the partially formed finger tips of the tines against the individual pins on the ring 60 to "set" the wire finger tips by slightly overbending these segments of the wire.

The rings 54 and 60 are rotated about the center 61 by means of a shaft 66. The shaft 66 is journalled for this rotation in bearings 67 and 70. The driving force for this rotation is provided through a drive gear 71 that is keyed or otherwise appropriately secured to the shaft 66. The fully formed wire stock, loosened on the rings 54, 60 through the action of the roller 62 is removed from the rings by wire strippers 72 and 73. The strippers 72, 73, which are a pair of flat plates, each bear against respective peripheral surfaces of the rings 54 and 60 on portions of these rings that are spaced just outwardly from the associated radially protruding pins in order to urge the base and finger tip segments of the stock away from the rings 54 and 60.

An arcuate, stationery metal strip provides a wire hold guide 74. As shown in FIG. 1, the wire hold guide 74 bears against the surface of the partially formed wire strand 52 as that wire strand is laced back and forth between the arrays of radially protruding pins on the rings 54 and 60. In this manner, the guide 74 keeps the partially formed strand of wire stock on the rings 54 and 60 until the flatening roll 62 and the pinch roll 63 have completed the work of finishing the product.

In operation, and as best illustrated in FIG. 1, the shaft 11 drives the forming arm members 33, 34 in the direction of the arrow 20. In so rotating the members 33, 34 the spherical cam followers 42 and 43 bear against the cam surface 15 in the cam plate 14 and enable the wear pads 47 and 51 on the forming arm members 33 and 34, respectively, to wind the strand 52 of wire onto the protruding pins 53 and 57 on the rings 54 and 60 without unequally stressing, deforming or marring the wire. Thus, as the forming arm member 34 is pivoted into alignment with the pin 53 that is immediately adjacent, the side pusher 55 moves toward the ring 54 and transfers the strand 52 from the wear pad 51 to the pin 53. The center pusher shaft 11 also moves toward the pin 57 on the ring 60 in order to press the immediately adjacent segment of the wire strand 52 onto the pin 57 as the forming arm member 33 and the associated wear pad 47 draw the "fingertip" portion of the strand 52 around the pin 57 through an arc that subtends about 180°.

The side pusher 55, as well as the center pusher shaft 11, are retracted or withdrawn in a direction that is radially away from the adjacent peripheral surfaces of the rings 54 and 60. This motion permits the indexing unit 10 to rotate the forming arm members 33 and 34 in the direction of the arrow 20 in order to draw the strand 52 into alignment with a new set of pins on the rings 54 and 60 which are indexed into position from behind the plane of the drawing. It should be noted in this respect that the center pusher shaft 11 and the side pusher 55 remain engaged with the adjacent segments of the strand 52 for a sufficient time to enable the indexing rings 54 and 60 to bring the now partially formed portion of the wire strand 52 under the wire hold guide 74.

As previously mentioned, a drive gear 71 indexes the ring shaft 66 in coordinate alignment of the pins on the rings 54, 60 with the motion of the forming arm members 33 and 34. It should be noted in this respect that the pinch roll 63 is driven through contact with the pins on the ring 60 in order to "dress up" or "set" the fingertips on the tines.

Consequently, as the rings 54 and 60 rotate, the wire strippers 72 and 73 urge the now formed wire stock from engagement with the pins on the rings 54 and 60.

Thus, there is provided a technique that enables a wire strand to be shaped into the basic comb-like wire bookbinding stock. This stock subsequently is inserted into aligned holes in the margin of book paper, whereupon the tines are bent into a generally circular shape, the fingertips of the tines approaching the back segments in order to complete the bookbinding, or the comb-like wire bookbinding stock is manufactured further into "E" or "C" shaped wire for other inserting methods. This device further produces formed stock in a manner that does not stretch, unequally stress or mar the surface of the wire in a manner that is significantly less costly than that which has characterized the prior art.

I claim:

1. Apparatus for producing wire bookbinding stock comprising a pusher shaft for rotation in incremental steps and for reciprocating motion relative to the axis of rotation, a hub for supporting said shaft, a pair of forming arm members secured to said hub for pivotal movement relative to said hub and for drawing wire from a supply, cam followers connected to said members for controlling the pivotal motion of said forming arm members, a ring spaced slightly from and in alignment with one of said forming arm members, a set of pins protruding radially from the rim of said ring for sequential alignment with one of said forming arm members, and another ring axially aligned in a plane parallel with and spaced axially from said ring, said another ring also having a set of pins protruding radially from the rim thereof for sequential alignment with said pusher shaft, whereby said forming arm members lace the wire around said sequentially aligned pins in order to keep uniform tension on the wire throughout winding to avoid creating stresses in the wire and thus produce wire bookbinding stock.

2. Apparatus for producing wire bookbinding stock comprising a pusher shaft for rotation in incremental steps and for reciprocating motion relative to the axis of rotation, a hub for supporting said shaft, a pair of forming arm members secured to said hub for pivotal movement relative to said hub and for drawing wire from a supply, cam followers connected to said members for controlling the pivotal motion of said forming arm members, a ring spaced slightly from and in alignment with one of said forming arm members, a set of pins protruding radially from the rim of said ring for sequential alignment with one of said forming arm members, another ring in a plane parallel with and spaced axially from said ring, said another ring also having a set of pins protruding radially from the rim thereof for sequential alignment with said pusher shaft whereby said forming arm members lace the wire around said sequentially aligned pins in order to produce wire bookbinding stock, a pinch roll for pressing the wire against said pins in the set protruding from said another ring and a wire flattening roll for pressing the wire against said pins in the set protruding from said ring in order to finish the wire bookbinding stock and loosen the stock on said sets of pins for removal therefrom.

3. Apparatus according to claim 2 further comprising a pair of wire strippers, said wire strippers each bearing against a respective ring rim adjacent to the individual sets of pins protruding from the surfaces thereof for urging the wire bookbinding stock from said pin sets.

4. Apparatus according to claim 1 further comprising a wire hold guide, said hold guide being spaced outwardly of said ring rims and extending over the spacing between said rings in order to bear against the wire laced between said pin sets and keep the laced wire in engagement with said pin sets.

5. Apparatus according to claim 1 further comprising a side pusher adjacent said one forming arm member for transferring the wire from said one forming arm member to said sequentially aligned pins in said pin set protruding from said ring, and said center pusher shaft pressing the wire onto said sequentially aligned pins protruding from the rim of said another ring in order to lace the wire around said sets of sequentially aligned pins.

* * * * *